US008291556B2

(12) United States Patent
Brownlow et al.

(10) Patent No.: US 8,291,556 B2
(45) Date of Patent: Oct. 23, 2012

(54) STRUCTURALLY REINFORCED CASKET AND MANUFACTURING METHOD

(75) Inventors: John Brownlow, Grand Rapids, MI (US); Timothy D. Derengowski, Kentwood, MI (US); Ricky L. Eustice, Hamilton, MI (US)

(73) Assignee: Clarion Technologies, Inc., Holland, MI (US)

( * ) Notice: Subject to any disclaimer, the term of this patent is extended or adjusted under 35 U.S.C. 154(b) by 0 days.

(21) Appl. No.: 13/086,069

(22) Filed: Apr. 13, 2011

(65) Prior Publication Data

US 2011/0252612 A1 Oct. 20, 2011

Related U.S. Application Data

(60) Provisional application No. 61/345,735, filed on May 18, 2010, provisional application No. 61/324,075, filed on Apr. 14, 2010.

(51) Int. Cl.
*A61G 17/00* (2006.01)

(52) U.S. Cl. ..... 27/3; 27/7; 27/19; 220/62.11; 220/653

(58) Field of Classification Search ..... 27/7, 2, 27/3, 19, 35; 220/62.11, 612–613, 645, 651–654, 220/677–678, 682, 560.15, 592.25, 62.22
See application file for complete search history.

(56) References Cited

U.S. PATENT DOCUMENTS 3,164,880 A * 1/1965 Hotchkiss Bruce M ..... 27/3
3,283,386 A * 11/1966 Cenegy Louis F ..... 27/3
3,353,238 A * 11/1967 Sieloff ..... 27/7
3,406,229 A * 10/1968 Cenegy Louis F ..... 264/46.5
3,541,747 A * 11/1970 Olson Eugene W et al. ... 52/141
3,879,818 A 4/1975 Rowland
3,927,788 A * 12/1975 Zinniger et al. ..... 220/560.05
4,174,556 A * 11/1979 Richings ..... 27/7
4,372,018 A * 2/1983 Miller et al. ..... 27/35
4,448,826 A 5/1984 Davidian
4,520,043 A 5/1985 Davidian
4,759,105 A * 7/1988 Buerosse ..... 27/1
4,800,631 A 1/1989 Pellmann
4,827,581 A 5/1989 Davidian
4,930,197 A * 6/1990 McClive ..... 27/2
RE34,846 E 2/1995 McGuire
5,615,464 A 4/1997 Rojdev
5,709,016 A * 1/1998 Gulick et al. ..... 27/2
5,740,592 A * 4/1998 Lau ..... 27/4
5,771,550 A 6/1998 Laphan et al.
D538,635 S 3/2007 De La Fuente
7,434,298 B2 10/2008 De La Fuente
7,581,293 B1 9/2009 Allen (Continued)

OTHER PUBLICATIONS

VertiCasket System Brochure, published at least as early as 2009.

*Primary Examiner* — William L. Miller
(74) *Attorney, Agent, or Firm* — Gardner, Linn, Burkhart & Flory, LLP

(57) ABSTRACT

A modular casket made of lightweight materials is structurally reinforced using a structural sealant, and/or longitudinally-arranged reinforcing members, and/or laterally-arranged reinforcing members, to stiffen and rigidize the casket against flexion along longitudinal and lateral axes, as well as torsional flexion. The structurally reinforced casket is sealed or more readily sealed against leakage and provides other benefits of structural stiffness and rigidity with relatively small cost and weight penalties.

20 Claims, 6 Drawing Sheets

U.S. PATENT DOCUMENTS

| | | | | |
|---|---|---|---|---|
| 7,703,186 | B1 | 4/2010 | Williamson | |
| 7,730,595 | B2 | 6/2010 | De La Fuente | |
| 2003/0029008 | A1* | 2/2003 | Biondo et al. | 27/2 |
| 2007/0056970 | A1* | 3/2007 | Scherer et al. | 220/62.22 |
| 2007/0181586 | A1* | 8/2007 | Van Ootmarsum et al. | 220/592.26 |
| 2010/0218350 | A1 | 9/2010 | De La Fuente | |

* cited by examiner

STRUCTURALLY REINFORCED CASKET AND MANUFACTURING METHOD

CROSS REFERENCE TO RELATED APPLICATIONS

The present application claims the priority benefit of U.S. provisional application Ser. No. 61/345,735, filed May 18, 2010, and of U.S. provisional application Ser. No. 61/324,075, filed Apr. 14, 2010, which are hereby incorporated herein by reference in their entireties.

FIELD OF THE INVENTION

The present invention relates in general to the field of coffins and caskets, and in particular, to modular caskets built from prefabricated components and/or caskets made of lightweight materials.

BACKGROUND OF THE INVENTION

Lightweight caskets, and particularly modular caskets, may be built from prefabricated component parts of lightweight materials such as injection molded plastics or the like. Such caskets typically exhibit relatively low rigidity, which can result in undesirable flexing of a casket when it is lifted from a support surface. Typically, such caskets are most susceptible to torsional flexion about the longitudinal axis and/or flexion about the lateral axis. In addition to the general undesirability of a casket flexing or twisting upon lifting, such flexing can lead to sealing problems between the individual components of the casket.

SUMMARY OF THE INVENTION

The present invention provides a structurally reinforced casket that includes strategically-placed reinforcing members and/or a casket liner, such as a sprayed-in liner, that significantly increase its torsional and flexural rigidity. The invention may be particularly well-suited for use with a modular casket that is constructed from lightweight prefabricated components made of resinous plastic or the like. The structural reinforcing members may include elongate rods arranged longitudinally along the length of the casket, and reinforcing members that span laterally across the casket to reinforce both a bottom or base panel of the casket and the side panels of the casket. Optionally, a two-part liner is applied to the casket interior in a liquid or semi-liquid state, which cures to a solidified or hardened state to both seal and rigidize the casket. The reinforced casket is consequently stiffened or rigidized against flexion or torsional bending, while remaining relatively inexpensive and lightweight.

According to one form of the present invention, a structurally reinforced casket includes a base panel having left and right edge portions, and left and right side panels coupled to the base panel in a generally upstanding manner at its left and right edge portions to define a cavity. A structural sealant applied to the inwardly-facing surfaces of the base panel and the left and right side panels. The sealant is cured to a hardened state to rigidize and seal the base panel and the left and right side panels.

In one aspect, the structural sealant has two layers: (i) a lower-density panel-lining first layer and (ii) a higher-density second layer that substantially covers the first layer and is generally spaced from the base panel and the left and right side panels by the first layer. Optionally, the first layer of the structural sealant is a urethane foam, and the second layer of the structural sealant is an acrylic or urethane material. Optionally, the first layer is a spray-applied thermoset urethane foam and the second layer is a spray-applied thermoset acrylic or urethane material.

In another aspect, the inwardly-facing surface of at least one of the base panel and the left and right side panels includes a plurality of stiffening ribs defining a plurality of voids therebetween. The structural sealant substantially fills these voids.

In yet another aspect, the casket includes at least one chosen from (i) at least one longitudinal reinforcing member arranged near at least one of the left and right edge portions of the base panel, and (ii) a lateral reinforcing member arranged transversely between the left and right side panels.

According to another form of the present invention, a method is provided for manufacturing a structurally reinforced casket. The method includes providing a base panel and left and right side panels, the base panel having left and right edge portions, coupling the left side panel and the right side panel to the base panel in a generally upstanding manner at the left edge portion and the right edge portion of the base panel, respectively, to define a cavity between respective inwardly-facing surfaces of the base panel and of the left and right side panels, applying at least one layer of liquid or semi-liquid structural sealant to the inwardly-facing surfaces of the base panel and the left and right side panels, and curing the layer of structural sealant to a hardened state to rigidize and seal the base panel and the left and right side panels.

In one aspect, the method further includes applying a second layer of liquid or semi-liquid structural sealant to the first layer of structural sealant, and curing the second layer of structural sealant to a hardened state to further rigidize and seal the first layer of structural sealant, the base panel, and the left and right side panels.

In another aspect, the first layer of structural sealant forms a relatively low-density foam in its hardened state, and the second layer of the structural sealant forms a substantially rigid polymeric layer in its hardened state.

Optionally, the step of applying the first layer of structural sealant involves spraying the first layer of structural sealant along the inwardly-facing surfaces of the base panel and the left and right side panels, and the step of applying the second layer of structural sealant involves spraying the second layer of structural sealant along the first layer of structural sealant.

In yet another aspect, the step of spraying the second layer of structural sealant is performed after the first layer of structural sealant is at least partially cured.

In still another aspect, the first layer of structural sealant is a urethane foam and the second layer of structural sealant is an acrylic or urethane. Optionally, the urethane foam and the acrylic are both thermoset materials that give off heat during the curing process.

According to another form of the present invention, a structurally reinforced casket includes a base panel, left and right side panels, and at least one chosen from (i) a longitudinal reinforcing member arranged near at least one of the left and right edge portions of the base panel, (ii) a lateral reinforcing member arranged transversely between the left and right side panels, and (iii) a sealant applied to inner surfaces of the casket and cured to a hardened state. The base panel includes head and foot end portions and left and right edge portions defining a perimeter region, with the left side panel and right side panel disposed at the left edge portion and the right edge portion of the base panel, respectively. The left side panel and the right side panel are coupled to the base panel in a generally upstanding manner to define a cavity between the panels.

In one aspect, each of the left and right side panels is made up of adjacent first and second panel portions, which are coupled to one another via at least one fastener.

In another aspect, in which the casket includes a longitudinal reinforcing member arranged along each of the left and right edge portions of the base panel, the longitudinal reinforcing members are formed from hollow tubes.

In a further aspect, the casket further includes a lateral reinforcing member in the form of at least one chosen from (i) a U-section bar, (ii) a square tube, and (iii) a round tube. Optionally, the lateral reinforcing member includes left and right upstanding leg portions arranged along respective ones of the left and right side panels, and further includes a horizontal portion spanning substantially between the left and right edge portions of the base panel and arranged transversely between the left and right side panels In a still further aspect, the casket further includes a two-layer sealant applied to respective inner surfaces of the left side panel, the right side panel, and the base panel casket. The two-layer sealant includes a lower-density panel-lining first layer and a higher-density second layer applied to the first layer. The first and second layers are both cured to a hardened state.

Thus, the structurally reinforced casket provides a lightweight, low-cost, rigidized and stiffened and sealed or more readily-sealable container, such as a modular casket, for supporting a deceased person. The reinforced casket may be lifted from a support surface substantially without flexion or twisting, and may be sealed against leakage.

These and other objects, advantages, purposes, and features of the present invention will become apparent upon review of the following specification in conjunction with the drawings.

DESCRIPTION OF THE PREFERRED EMBODIMENTS

Figure 1:
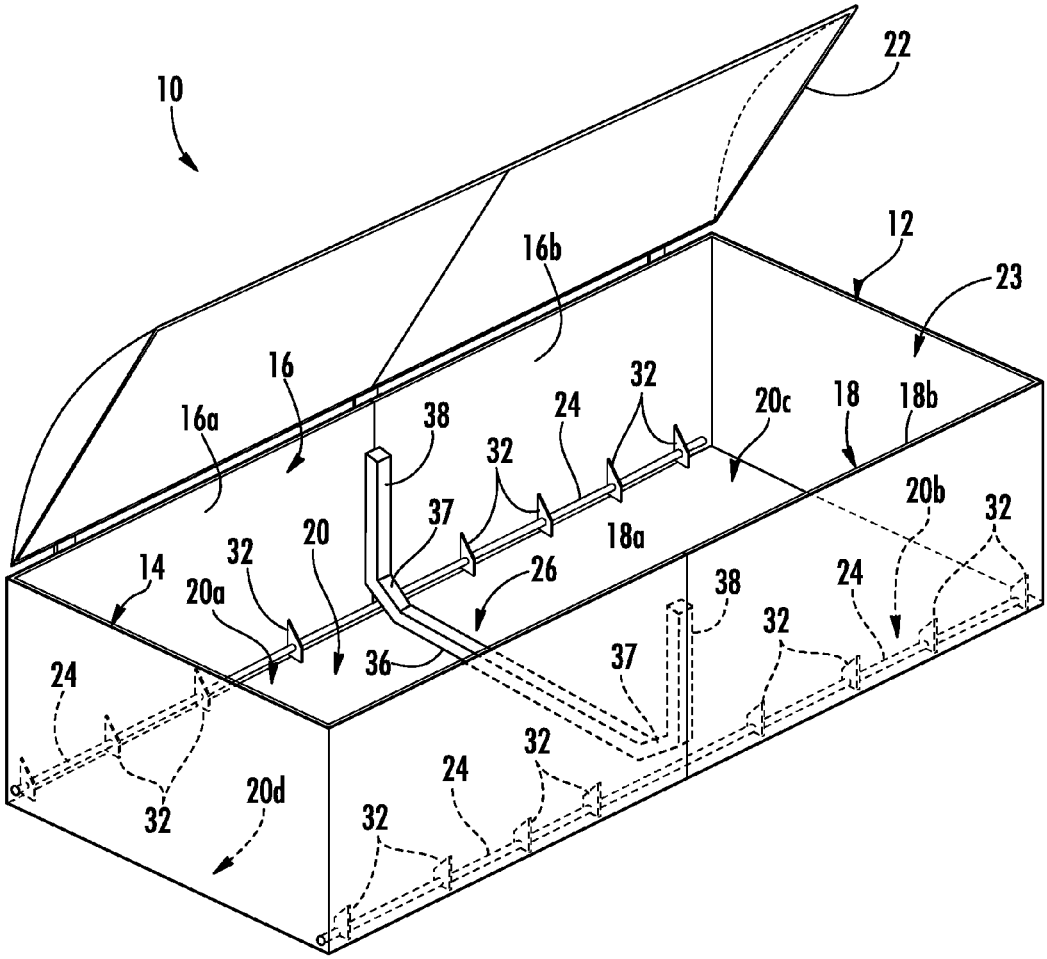
FIG. 1 is a perspective view of a structurally reinforced casket in accordance with the present invention.
Figure 2:
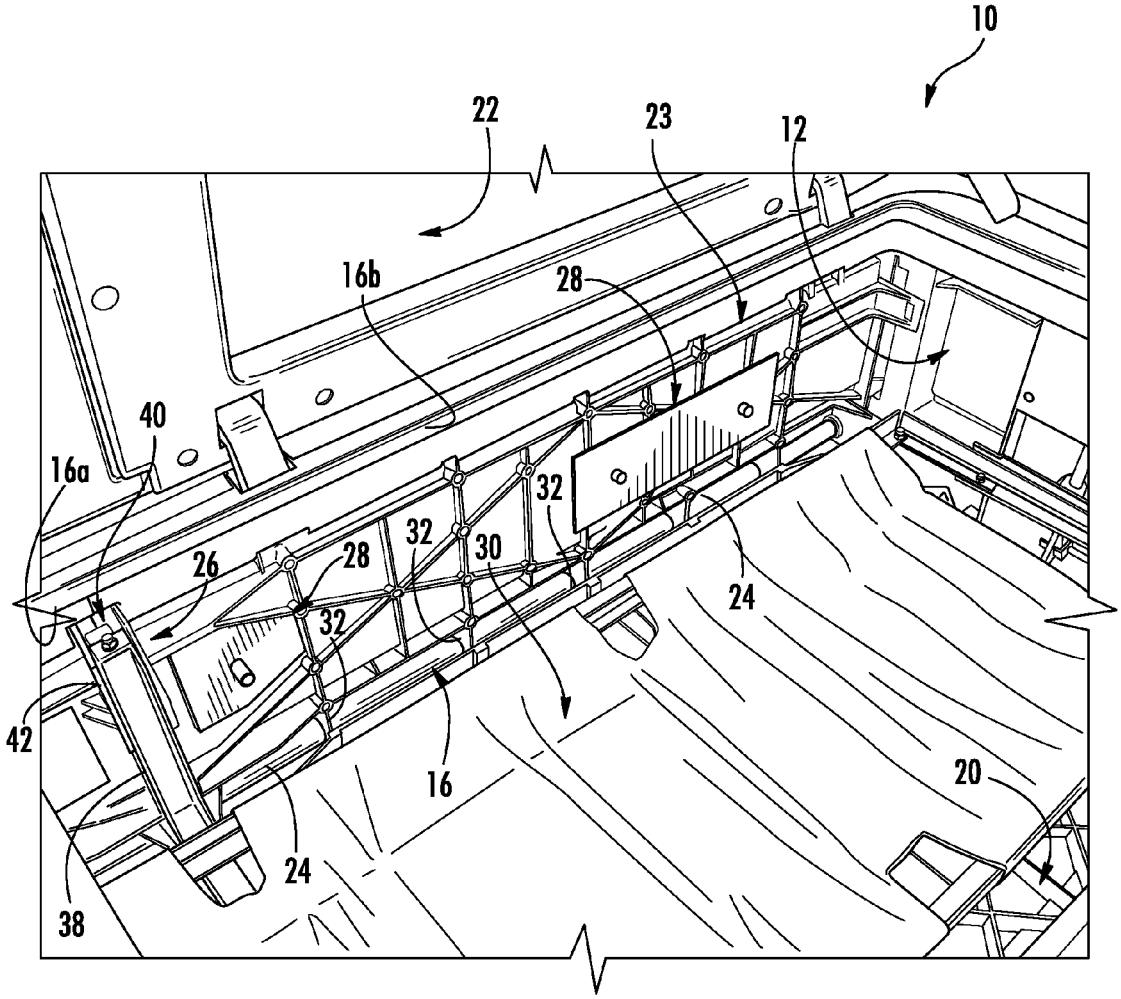
FIG. 2 is a perspective view of the interior foot end region of a structurally reinforced casket substantially similar to the casket of FIG. 1.

The present invention is directed to a structurally reinforced casket, and more specifically, to a structurally reinforced modular casket made of prefabricated components, and particularly one that is made of lightweight materials, such as injection molded plastics or the like. While the present invention is described with reference to a modular rectangular casket made of injection molded plastic material, it should be understood that the same or similar principals may be used with substantially any casket in which structural reinforcement and/or stiffening is desired. As will be more fully described below, the structural reinforcements include longitudinal reinforcing rods or members arranged along the sides of the casket, and lateral reinforcing members such as generally U-shaped cross-members arranged transversely along the walls or panels of the casket. In other embodiments, the structural reinforcements include liner materials that are applied to the interior surfaces of the casket in a liquid or semi-liquid uncured state, and which cure to a hardened state that rigidizes and seals the casket. The structural reinforcements are substantially hidden from view by upholstery or other materials when the casket is fully assembled.

Referring now to FIGS. 1-4, a modular casket 10 includes a foot end panel 12, a head end panel 14, a left side panel 16, a right side panel 18, a base panel 20, and a movable hinged lid 22 defining a cavity 23 for receiving a deceased person. Casket 10 is fitted with structural reinforcing members including a pair of longitudinal reinforcing members 24 arranged along opposite interior corners or edge portions of the casket, and a lateral reinforcing member in the form of a U-shaped reinforcing member 26 arranged transversely along the casket midway between foot end panel 12 and head end panel 14. The reinforcing members 24, 26 substantially enhance the structural rigidity of casket 10, particularly when the casket is lifted from a support surface (such as by pall-bearers).

In the illustrated embodiment, each of the left and right side panels 16, 18 is made up of a pair of panel portions 16*a-b*, 18*a-b* that are joined together halfway between head end panel 14 and foot end panel 12. The end panels 12, 14; side panels 16, 18; base panel 20; and movable hinged lid 22 may be joined together via interlocking components and/or fasteners, for example. Base panel 20 has a perimeter region defined by a left edge portion 20*a*, a right edge portion 20*b*, a foot end portion 20*c*, and a head end portion 20*d* (FIGS. 1-5) to which left side panel 16, right side panel 18, foot end panel 12, and head end panel 14 are coupled, respectively. Although the illustrated embodiment is rectangular in shape, it will be appreciated that the principles of the present invention may be practiced with other shapes, such as oval shapes and the like, in which there may not be distinct or separate head and foot end panels.

In addition, modular casket 10 may include interior reinforcements 28 (FIGS. 2 and 6) for exterior handles (not shown), and an adjustable-height support cot 30 (FIGS. 2 and 5-6), as well as various other finishing components. A more complete understanding of the panel joining features, methods, and other design features or elements of modular caskets may be obtained with reference to U.S. Pat. No. 7,730,595, the disclosure of which is hereby incorporated herein by reference.

Figure 6:
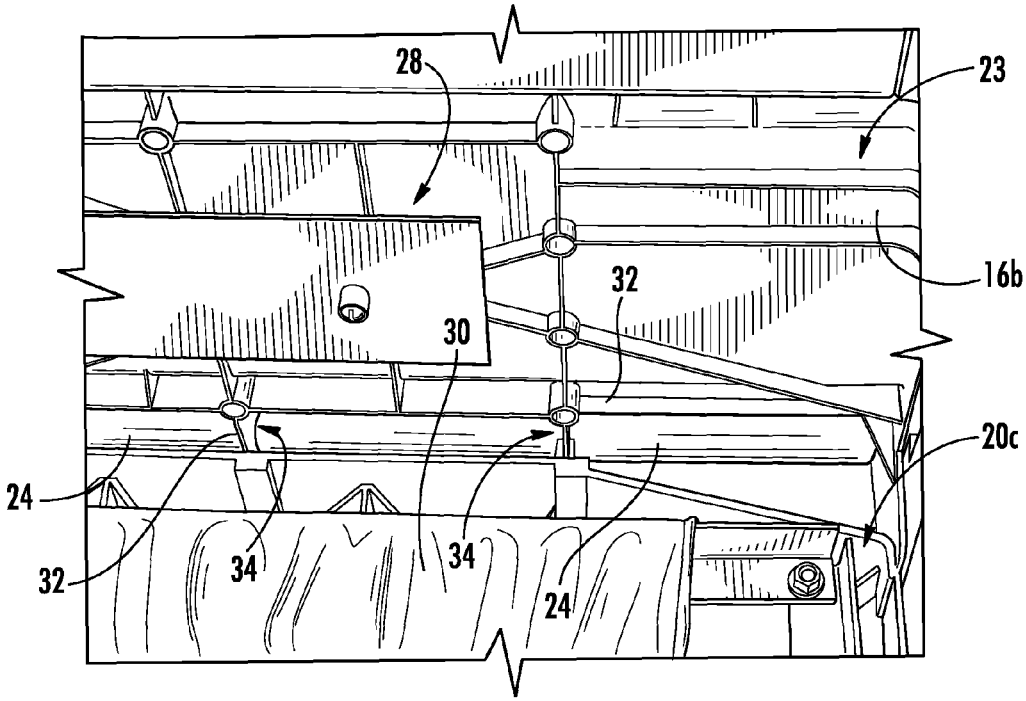
FIG. 6 is an enlarged perspective view of another interior portion of the casket.

Longitudinal reinforcing members 24 are arranged and disposed along respective corner regions defined between or near the respective intersections of left and right side panels 16, 18 with base panel 20. It will be appreciated that the longitudinal reinforcing member 24 along the right side panel 18 is substantially identical or formed as a "mirror image" relative to the longitudinal reinforcing member 24 along left side panel 16. Left and right side panels 16, 18 each include a plurality of spaced ribs or flanges 32 along a lower portion of the respective side panel near where it meets and joins to base panel 20. Each spaced flange 32 includes an aperture or through-hole 34 for receiving one of the longitudinal reinforcing members 24. The through-holes 34 of a given side panel are substantially co-axial and sized and shaped to receive longitudinal reinforcing member 24 (FIG. 6).

In the illustrated embodiment of FIGS. 1-6, longitudinal reinforcing members 24 are hollow metal tubes that are circular in cross section and span substantially the full length of left and right side panels 16, 18. During assembly of the modular casket 10, the longitudinal reinforcing members 24 may be inserted through the through-holes 34 of spaced flanges 32 prior to installation of the foot end panel 12 and/or the head end panel 14. Once installed, the foot and head end panels 12, 14 cover the opposite ends of longitudinal reinforcing members 24, and prevent removal of the longitudinal reinforcing members 24 when the casket 10 is fully assembled. It will be appreciated that a greater or lesser number of longitudinal reinforcing members may be installed in spaced arrangement along the bottom panel of the casket, without departing from the spirit and scope of the present invention.

Figure 3:
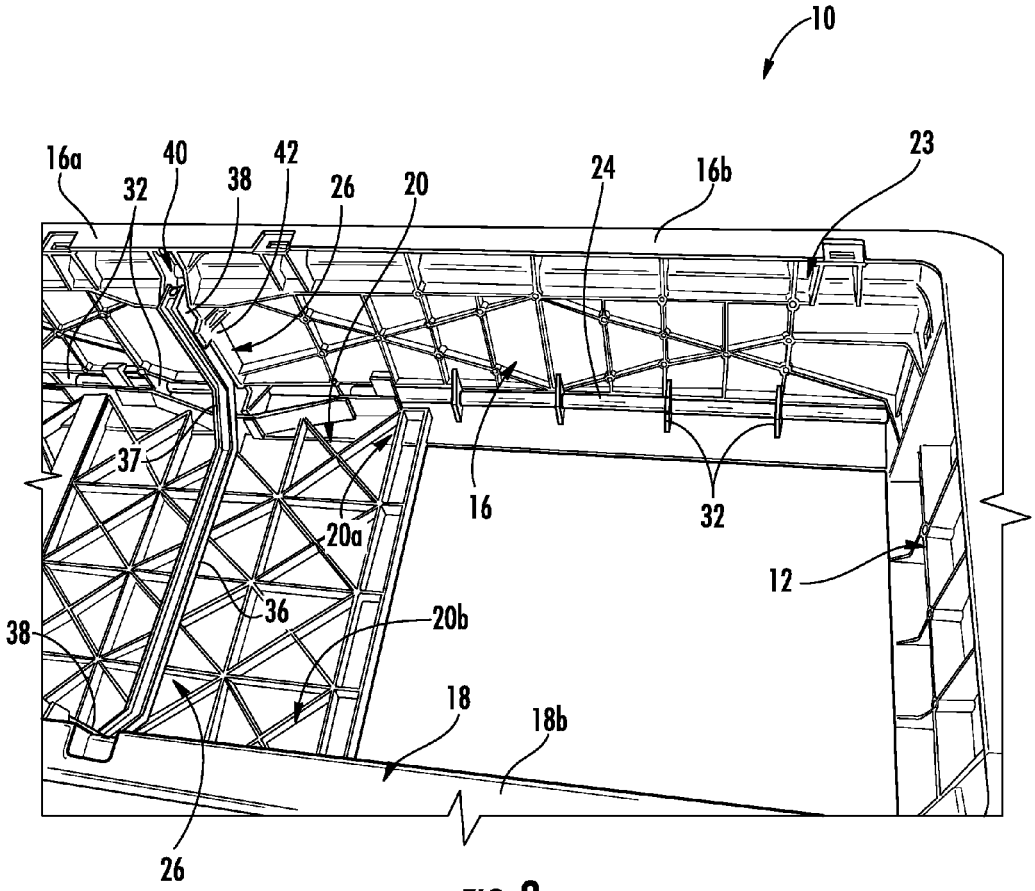
FIG. 3 is another perspective interior view of the casket of FIG. 2, in which several components are removed for clarity.
Figure 4:
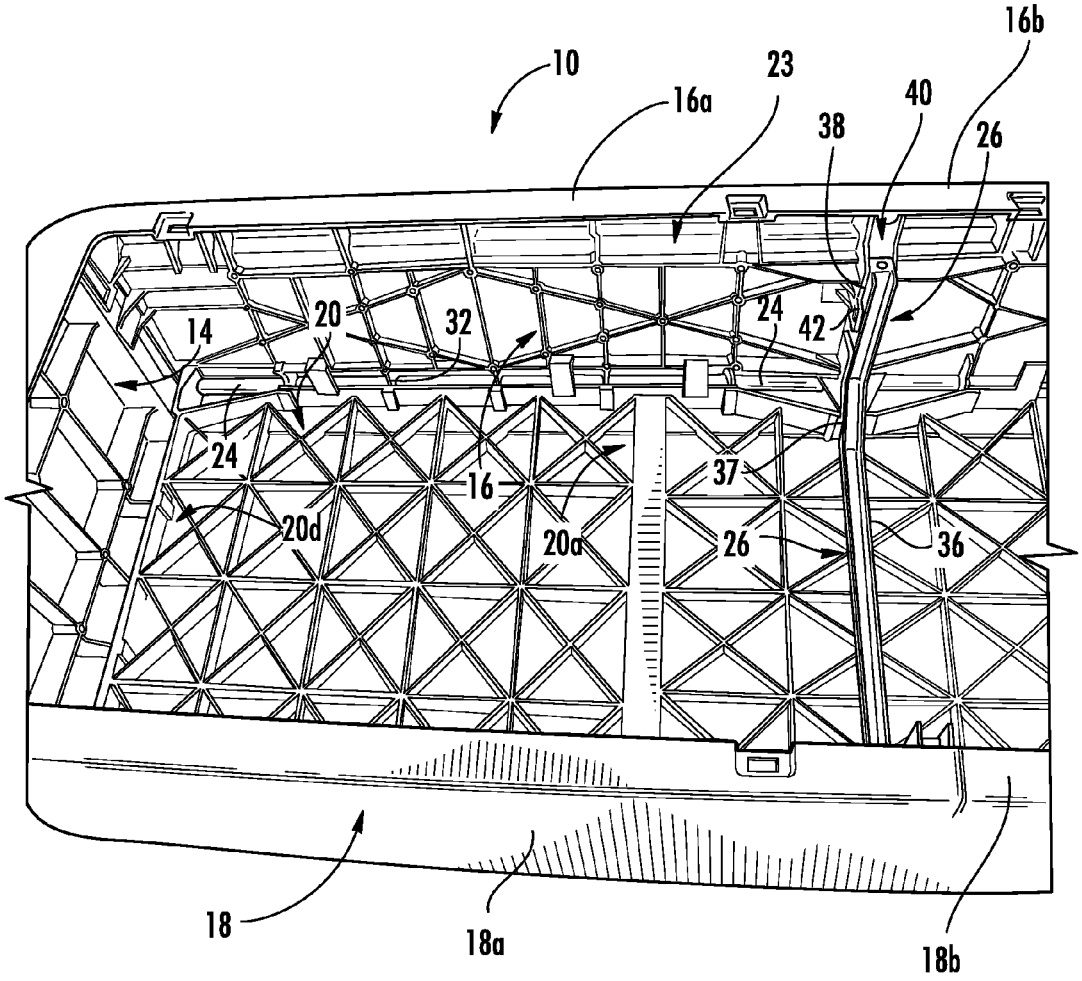
FIG. 4 is a perspective view of the interior head end region of the casket, in which several interior components are removed for clarity.
Figure 5:
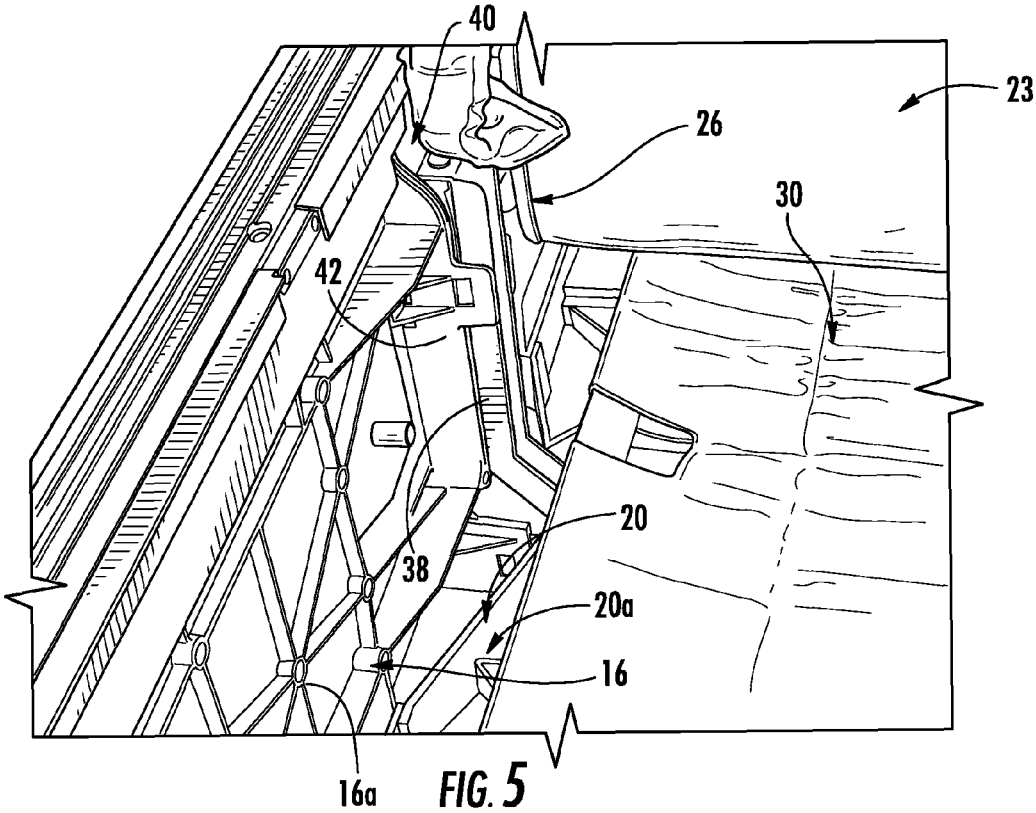
FIG. 5 is an enlarged perspective view of an interior portion of the casket.

Lateral or U-shaped reinforcing member 26 includes a horizontal portion 36 and upstanding leg portions 38 that are substantially perpendicular to horizontal portion 36 (FIGS. 1, 3 and 4). Horizontal portion 36 spans substantially across the width of base panel 20, and is arranged so that the upstanding leg portions 38 are received and supported (such as via a snap-fit) in respective vertical channels 40 defined by clip members 42 (FIGS. 2-5). In the illustrated embodiment, interlocking clip members 42 join or fasten the two panel portions that make up each of left side panel 16 and right side panel 18, as may be more fully understood with reference to U.S. Pat. No. 7,730,595, which is incorporated herein by reference. Clip members 42 support the upstanding leg portions 38 of U-shaped reinforcing member 26 midway between foot end panel 12 and head end panel 14.

Optionally, lateral or U-shaped reinforcing member 26 may be coupled to one or more of the left and right side panels 16, 18 and base panel 20 using mechanical fasteners, adhesives, welding, or the like, to provide enhanced structural support and resistance to torsional bending or flexion of the casket 10. It will be appreciated that multiple U-shaped reinforcing members may be positioned in spaced arrangement along the interior of casket 10 to increase the stiffness or rigidity of the casket to a desired degree. In the illustrated embodiment, U-shaped reinforcing member 26 is a metal U-section bar arranged with the open side of the U-section facing generally upwardly, the U-section bar being bent to form horizontal portion 36 and upstanding leg portions 38, with intermediate angled portions 37 disposed between horizontal portion 36 and leg portions 38, thus forming the U-shape of lateral reinforcing member 26 (FIGS. 1, 3 and 4). However, it will be appreciated that other shapes (i.e. other than U-shapes) and materials may be used without departing from the spirit and scope of the present invention. For example, one or more lateral reinforcing members that are substantially straight or non-U-shaped, or that are arranged diagonally across the casket bottom panel, or the like, are envisioned. Optionally, the lateral and longitudinal reinforcing members may be made of different tubular shapes (e.g. circular, oval, square, or other polygon), or of solid-section, open-section, or other shapes (e.g. cruciform, I-beam or H-beam, etc.), for example, and may optionally be made of metal or non-metal, or substantially any sufficiently strong, rigid material.

Accordingly, longitudinal reinforcing members 24 and U-shaped reinforcing member 26 are positioned along the interior surfaces of casket 10 so as to be unobtrusive and readily concealed by other interior components of the casket (e.g., a raisable/lowerable support cot 30 and finishing upholstery), so that the appearance of the finished casket is substantially unaffected by the installation of the structural supports or reinforcing members. Longitudinal reinforcing members 24 resist bending loads and thus resist flexing of the casket 10 about a lateral axis (i.e., an axis substantially parallel to the horizontal portion 36 of U-shaped reinforcing member 26), and also resist torsional flexing of the casket whereby foot end panel 12 and head end panel 14 would rotate relative to one another about a longitudinal axis (i.e., an axis that is substantially parallel to longitudinal reinforcing members 24).

Lateral reinforcing member 26 resists inward bending of left and right side panels 16, 18, resists flexing of the entire casket 10 about its longitudinal axis, and also resists torsional flexing. The rigidizing or stiffening effect of the lateral reinforcing member may be increased by using two or more lateral reinforcing members spaced longitudinally along the interior of the casket. For example, a "heavy duty" structurally reinforced casket may be constructed with two or three or more U-shaped reinforcing members 26 or other cross-members in spaced arrangement between the foot and head end panels 12, 14.

Figure 7:
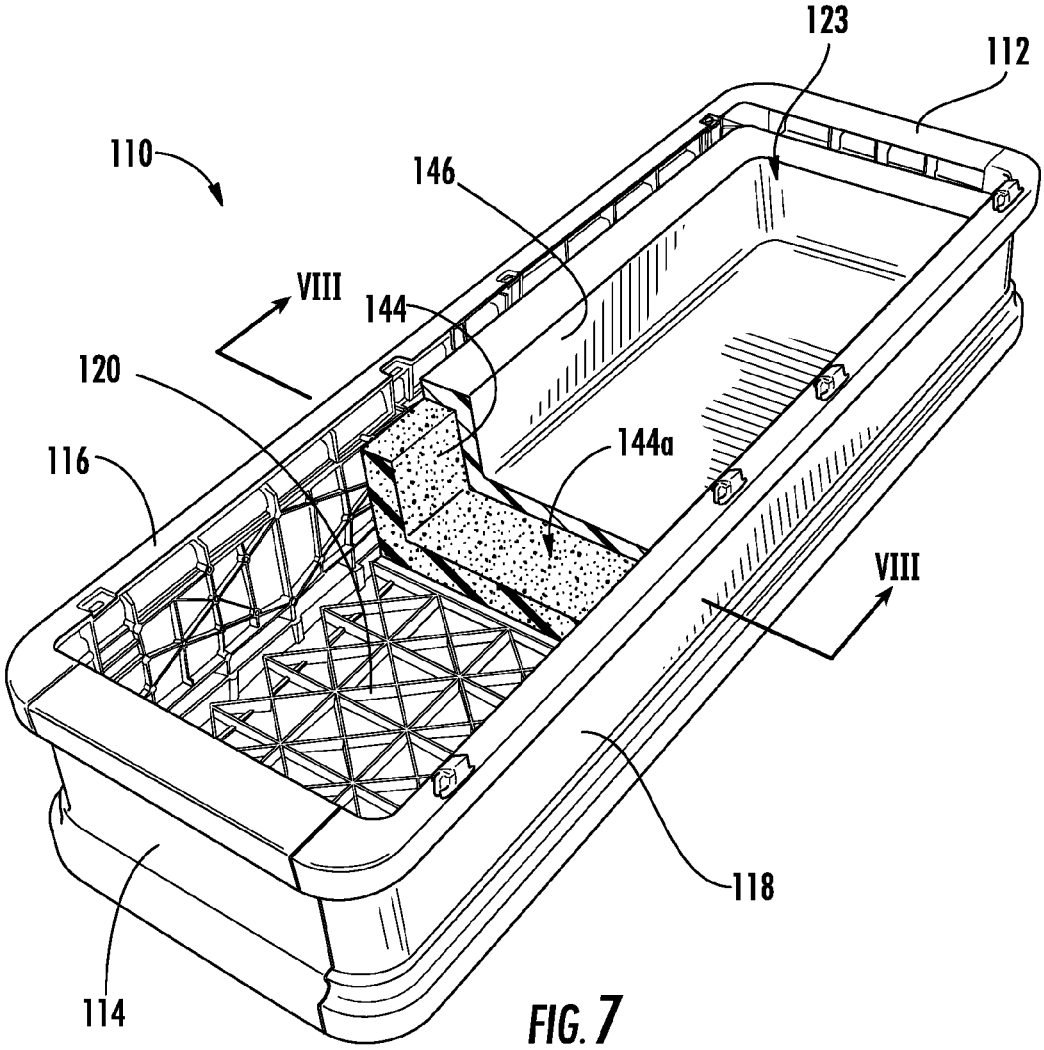
FIG. 7 is a perspective view of another casket in accordance with the present invention, showing portions of sealing and reinforcing layers applied to the casket interior.
Figure 8:
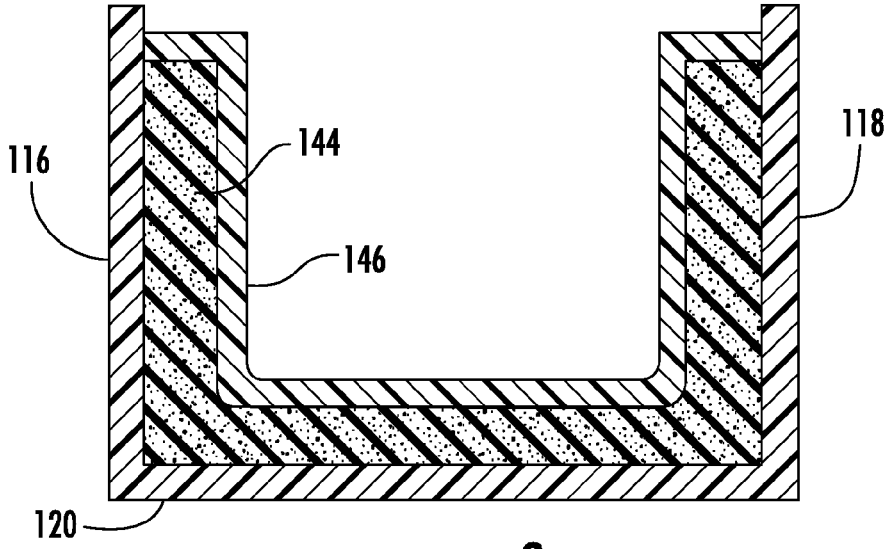
FIG. 8 is a sectional view taken along line VIII-VIII of FIG. 7.

Optionally, and with reference to FIGS. 7 and 8, another modular casket 110 includes a foot end panel 112, a head end panel 114, a left side panel 116, a right side panel 118, and a base panel 120, each of which may be made up of one or more separate panels that are joined together. A movable hinged lid (not shown in FIGS. 7 and 8) is attached to one of the left side panel 116 or right side panel 118. Foot end panel 112, head end panel 114, left side panel 116, right side panel 118, and base panel 120 cooperate to define a cavity 123 for receiving a deceased person. The panels of casket 110 may be substantially identical or similar to those of casket 10, described above, such that their arrangement and features may be readily understood with reference to the above description. However, rather than relying on longitudinal and/or lateral reinforcing members for structural rigidity of the casket, the interior of casket 110 receives a two-part resinous lining for sealing and enhancing the structural rigidity of the finished casket.

Once the panels of casket 110 are assembled together, a two-layer structural sealant includes a lightweight panel liner 144 that is sprayed or spread (or applied in a similar manner) along all of the interior surfaces of foot end panel 112, head end panel 114, left side panel 116, right side panel 118, and base panel 120 that define cavity 123. For example, panel liner 144 may be a thermoset urethane foam that is applied in a liquid or semi-liquid state (such as a liquid resin) with sufficient thickness to substantially fill the spaces or voids between all of the stiffening ribs along the interior surfaces of the panels, and which may have a cured density of approximately two pounds per cubic foot (2-lb/ft$^3$). However, the density of panel liner 144 may be increased to as much as approximately six pounds per cubic foot (6-lb/ft$^3$) when used in conjunction with inner liner 146, to as much as approximately twelve pounds per cubic foot (12-lb/ft$^3$), for example, if the panel liner is to be used as a stand-alone structural sealant layer.

Panel liner 144 leaves a generally smooth inner surface 144*a* once it has cured, and although panel liner 144 is shown for clarity in FIGS. 7 and 8 as being relatively thick as compared to the thickness of the casket panels, it will be appreciated the panel liner 144 may actually be relatively thin, such as about ½-inch to 1-inch thick, and its thickness may generally correspond to the height or depth of the stiffening ribs of the casket panels. When panel liner 144 is a thermoset material, for example, its curing process involves an exothermic reaction that gives off heat. Panel liner 144 tends to fill gaps and form a seal between all of the individual panels that make up the casket, and may exhibit relatively low density (and may also be relatively flexible and low in strength) to minimize the weight added to the casket. Thus, panel liner 144 forms a continuous or monolithic tub-like liner that may be substantially fluid-impervious and vapor-impervious, depending on its porosity and material properties.

Once lightweight panel liner 144 is at least partially cured, a second layer of the structural sealant in the form of an inner liner 146 is applied to inner surface 144*a* of panel liner 144. Inner liner 146 is significantly stronger and stiffer than panel liner 144, and forms a tub-like inner seal and structural shell of the casket 110 once it has been cured, such as in an exothermic reaction. Although inner liner 146 is shown for clarity in FIGS. 7 and 8 as being relatively thick as compared to the thickness of the casket panels, it will be appreciated the inner liner 146 may actually be quite thin relative to the casket panels and panel liner. For example, inner liner 146 may be about three to four millimeters (3 mm-4 mm, or about 0.12-inch to 0.16-inch) in thickness.

Inner liner 146 may be an acrylic or urethane thermoset material that is sprayed or spread (or applied in a similar manner) in a liquid or semi-liquid state (such as liquid resin) along inner surface 144*a* of panel liner 144, and allowed to cure to a hardened state having a density of approximately eighty pounds per cubic foot (80-lb/ft$^3$), for example. Suitable materials for inner liner 146 include ACRYLOBOND® brand TP-1155-4 two-component polyurethane, which is available from Isotec International, Inc. of Canton, Ga., and which can be sprayed using a two-component high-pressure spray machine. Optionally, the material inner liner 146 may incorporate glass or other fibers for added strength and rigidity. Inner liner 146 thus forms a substantially fluid-impervious and vapor-impervious layer over panel liner 144.

Optionally, and without departing from the spirit and scope of the present invention, panel liner 144 and inner liner 146 may be applied to a modular casket with one or more longitudinal or lateral reinforcing members already in place, such as described above with reference to casket 10, so that the reinforcing members are encased in at least the panel liner material. It is envisioned that this arrangement would further rigidize the finished casket, albeit with potentially increased weight and cost.

It will be appreciated that the structural sealant of the present invention is not limited to a two-layer sealant as shown, and that a single-layer or three or more layer structural sealant may be used to rigidize and seal the casket, depending on the particular casket's desired strength, weight, and stiffness requirements, for example. In the case of a single-layer structural sealant, for example, it may be desirable to select a cured foam material having a density greater than that of the panel liner 144 described above, and less than that of the inner liner 146, such as a density of about six to twelve pounds per cubic foot (6-lb/ft$^3$ to 12-lb/ft$^3$). Thus, it will be appreciated that the thickness and density of panel liner 144 and inner liner 146 (when included) may be varied significantly to achieve the desired strength-to-weight ratio for the finished casket, with the thickness and/or density of the panel liner generally increasing when a thinner or weaker inner liner is used, and vice versa, to achieve desired properties of the finished casket. Panel liner 144 and inner liner 146 may also be made thinner and/or of comparatively weaker materials if used in combination with longitudinal or lateral reinforcing members, described above.

Once panel liner 144 and inner liner 146 have both at least partially cured, a cot, upholstery, and other finishing hardware and materials may be installed or applied to the casket 110 so that the interior surfaces of the casket panels, and the panel liner 144 and inner liner 146, are completely covered and obscured by the casket upholstery. Upholstery may be attached to inner surfaces of inner liner 146 and any exposed inwardly-facing surfaces of foot end panel 112, head end panel 114, left side panel 116, and right side panel 118 that are not covered by inner liner 146, using mechanical fasteners such as hook-and-loop fasteners, threaded screws, magnets, or the like.

The resultant casket 110 is substantially rigidized and sealed by the application of the low-density panel liner 144 and the higher-strength inner liner 146 to the interior surfaces of foot end panel 112, head end panel 114, left side panel 116, right side panel 118, and base panel 120. The panels are substantially permanently joined together by the cured liner layers, and the casket 110 is strong, stiff, and still relatively lightweight with its hardened inner and outer shells (i.e. inner liner 146 and combined end panels 112, 114, side panels 116, 118, and base panel 120) with lightweight inner foam core (i.e., panel liner 144).

Thus, the present invention provides a modular casket that may be made of lightweight materials, such as plastics including thermoplastics [such as acrylonitrile butadiene styrene (ABS)] or other polymeric material or the like, and which is structurally reinforced to substantially limit or prevent undesirable flexing or bending of the casket, particularly when the casket is lifted from a support surface. The structural reinforcement of a modular casket also facilitates sealing it against leakage by limiting the extent to which the prefabricated panels will move relative to one another during handling, and/or by filling gaps with a sealing material. This reduces or fills gaps and increases the effectiveness of gaskets or seals that may optionally be used between the panels to seal the casket. The structural reinforcing members or materials are unobtrusive and readily obscured or covered by other components of the casket, such as upholstery. Thus, a modular casket is provided that is structurally reinforced without substantial penalties in aesthetics, cost, or weight.

Changes and modifications in the specifically described embodiments may be carried out without departing from the principles of the present invention, which is intended to be limited only by the scope of the appended claims, as interpreted according to the principles of patent law including the doctrine of equivalents.

The embodiments of the invention in which an exclusive property is claimed are defined as follows:

1. A structurally reinforced modular casket comprising:

a base panel having head and foot end portions and left and right edge portions;

a head end panel and a foot end panel mechanically coupled to said head end portion and said foot end portion of said base panel, respectively, in a generally upstanding manner;

a left side panel and a right side panel mechanically coupled to said left edge portion and said right edge portion of said base panel, respectively, and said left side panel and said right side panel mechanically coupled to said base panel in a generally upstanding manner to define a cavity between respective inwardly-facing surfaces of said base panel, said left and right side panels, and said head and foot end panels, for receiving a deceased body;

a lid that is positionable atop said left and right side panels and said head and foot end panels for enclosing said cavity;

a structural sealant applied in an uncured state to the inwardly-facing surfaces of said base panel, said left and right side panels, and said head and foot end panels to form a substantially continuous and generally tub-shaped sealant layer lining the inwardly-facing surfaces and filling a portion of said cavity; and wherein said sealant is cured to a hardened state to rigidize, seal, and substantially permanently join said base panel, said left and right side panels, and said head and foot end panels.

2. The structurally reinforced modular casket of claim 1, further comprising at least one chosen from (i) at least one longitudinal reinforcing member arranged near at least one of said left and right edge portions of said base panel, and (ii) a lateral reinforcing member arranged transversely between said left and right side panels.

3. The structurally reinforced modular casket of claim 1, wherein said structural sealant comprises first and second layers.

4. The structurally reinforced modular casket of claim 3, wherein said first layer of said structural sealant comprises a lower-density panel-lining layer and said second layer comprises a higher-density layer that substantially covers said first layer and is generally spaced from said base panel, and said left and right side panels, and said head and foot end panels, by said first layer.

5. The structurally reinforced modular casket of claim 4, wherein said first layer of said structural sealant comprises a foam.

6. The structurally reinforced modular casket of claim 5, wherein said second layer of said structural sealant forms a substantially solid sheet layer.

7. The structurally reinforced modular casket of claim 6, wherein said first layer comprises a spray-applied thermoset urethane foam and said second layer comprises a spray-applied thermoset acrylic or urethane.

8. A structurally reinforced modular casket comprising:

a base panel having head and foot end portions and left and right edge portions;

a head end panel and a foot end panel mechanically coupled to said head end portion and said foot end portion of said base panel, respectively, in a generally upstanding manner;

a left side panel and a right side panel disposed at said left edge portion and said right edge portion of said base panel, respectively, and said left side panel and said right side panel coupled to said base panel and to said head and foot end panels in a generally upstanding manner to define a cavity between respective inwardly-facing surfaces of said base panel, of said head and foot end panels, and of said left and right side panels, for receiving a deceased body;

a lid that is positionable atop said left and right side panels and said head and foot end panels for enclosing said cavity;

a structural sealant applied to the inwardly-facing surfaces of said base panel, said left and right side panels, and said head and foot end panels to form a substantially continuous sealant layer that is cured to a hardened state to rigidize, seal, and substantially rigidly join said base panel, said left and right side panels, and said head and foot end panels; and wherein said structural sealant comprises a lower-density panel-lining first layer and a higher-density second layer that substantially covers said first layer and is generally spaced from said base panel and said left and right side panels by said first layer.

9. The structurally reinforced modular casket of claim 8, wherein said first layer of said structural sealant comprises a foam.

10. The structurally reinforced modular casket of claim 8, wherein said second layer of said structural sealant forms a substantially solid sheet layer.

11. The structurally reinforced modular casket of claim 8, wherein said first layer comprises a spray-applied thermoset urethane foam and said second layer comprises a spray-applied thermoset acrylic or urethane.

12. A structurally reinforced modular casket comprising:

a base panel having head and foot end portions and left and right edge portions;

a head end panel and a foot end panel mechanically coupled to said head end portion and said foot end portion of said base panel, respectively, in a generally upstanding manner;

a left side panel and a right side panel disposed at said left edge portion and said right edge portion of said base panel, respectively, and said left side panel and said right side panel coupled to said base panel and to said head and foot end panels in a generally upstanding manner to define a cavity between respective inwardly-facing surfaces of said base panel and of said left and right side panels, for receiving a deceased body;

a lid that is positionable atop said left and right side panels and said head and foot end panels for enclosing said cavity;

a structural sealant applied to the inwardly-facing surfaces of said base panel and said left and right side panels to form a substantially continuous sealant layer that is cured to a hardened state to rigidize, seal, and substantially permanently join said base panel, said left and right side panels, and said head and foot end panels; and wherein the inwardly-facing surface of at least one of said base panel and said left and right side panels comprises a plurality of stiffening ribs defining a plurality of voids therebetween, and wherein said structural sealant substantially fills said voids.

13. A structurally reinforced modular casket comprising:

a base panel having head and foot end portions and left and right edge portions defining a perimeter region;

a head end panel and a foot end panel mechanically coupled to said head end portion and said foot end portion of said base panel, respectively, in a generally upstanding manner;

a left side panel and a right side panel disposed at said left edge portion and said right edge portion of said base panel, respectively, and said left side panel and said right side panel coupled to said base panel and to said head and foot end panels in a generally upstanding manner to define a cavity between inwardly-facing surfaces of said base panel and said left and right side panels for receiving a deceased body, said left and right side panels each having a plurality of stiffening ribs;

a lid that is positionable atop said left and right side panels and said head and foot end panels for enclosing said cavity; and at least one chosen from (i) at least one longitudinal reinforcing member arranged near at least one of said left and right edge portions of said base panel and positioned in a through-hole formed in each of said stiffening ribs of said left or right side panel, and (ii) a structural sealant applied in an uncured state to said inwardly-facing surfaces of said base panel, said left and right side panels, and said head and foot end panels, and cured to a hardened state to form a generally tub-shaped sealant layer lining and substantially permanently joining the inwardly-facing surfaces of said base panel, said left and right side panels, and said head and foot end panels, and filling a portion of said cavity.

14. The structurally reinforced modular casket of claim 13, wherein each of said left and right side panels comprises adjacent first and second panel portions, said first and second panel portions coupled to one another via at least one fastener.

15. The structurally reinforced modular casket of claim 13, comprising a lateral reinforcing member having left and right upstanding leg portions arranged along respective ones of said left and right side panels, and further comprising a horizontal portion spanning substantially between said left and right edge portions of said base panel arranged transversely between said left and right side panels.

16. The structurally reinforced modular casket of claim 13, comprising said structural sealant in the form of a two-layer structural sealant applied to respective inner surfaces of said left side panel, said right side panel, said head end panel, said foot end panel, and said base panel of said casket, said two-layer sealant including a lower-density panel-lining first layer and a higher-density second layer applied to said first layer, said first and second layers both being cured to a hardened state.

17. A structurally reinforced modular casket comprising:

a base panel having head and foot end portions and left and right edge portions defining a perimeter region;

a head end panel and a foot end panel mechanically coupled to said head end portion and said foot end portion of said base panel, respectively, in a generally upstanding manner;

a left side panel and a right side panel disposed at said left edge portion and said right edge portion of said base panel, respectively, and said left side panel and said right side panel coupled to said base panel and to said head and foot end panels in a generally upstanding manner to define a cavity between inwardly-facing surfaces of said base panel, said head and foot end panels, and said left and right side panels;

a lid that is positionable atop said left and right side panels and said head and foot end panels for enclosing said cavity;

at least one chosen from (i) a longitudinal reinforcing member in the form of a hollow tube arranged along at least one of said left and right edge portions of said base panel, and (ii) a structural sealant applied in an uncured state to said inwardly-facing surfaces of said base panel, said left and right side panels, and said head and foot end panels, and cured to a hardened state to form a generally tub-shaped sealant layer lining and substantially permanently joining the inwardly-facing surfaces of said base panel, said left and right side panels, and said head and foot end panels, and filling a portion of said cavity.

18. The structurally reinforced modular casket of claim 17, wherein each of said left and right side panels comprises adjacent first and second panel portions, said first and second panel portions coupled to one another via at least one fastener.

19. The structurally reinforced modular casket of claim 17, comprising a lateral reinforcing member having left and right upstanding leg portions arranged along respective ones of said left and right side panels, and further comprising a horizontal portion spanning substantially between said left and right edge portions of said base panel arranged transversely between said left and right side panels.

20. The structurally reinforced modular casket of claim 17, comprising said structural sealant in the form of a two-layer structural sealant applied to respective inner surfaces of said left side panel, said right side panel, said head end panel, said foot end panel, and said base panel of said casket, said two-layer sealant including a lower-density panel-lining first layer and a higher-density second layer applied to said first layer, said first and second layers both being cured to a hardened state.

* * * * *